US011167312B2

(12) United States Patent
Overholser

(10) Patent No.: US 11,167,312 B2
(45) Date of Patent: Nov. 9, 2021

(54) SLURRY-BASED COATING SYSTEM REPAIR

(71) Applicant: Rolls-Royce North American Technologies, Inc., Indianapolis, IN (US)

(72) Inventor: Ronald Walter Overholser, Carmel, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 229 days.

(21) Appl. No.: 16/426,988

(22) Filed: May 30, 2019

(65) Prior Publication Data

US 2020/0230645 A1 Jul. 23, 2020

Related U.S. Application Data

(60) Provisional application No. 62/679,547, filed on Jun. 1, 2018, provisional application No. 62/827,584, filed on Apr. 1, 2019.

(51) Int. Cl.
*B05D 5/00* (2006.01)
*B05D 3/02* (2006.01)

(52) U.S. Cl.
CPC ..... *B05D 5/005* (2013.01); *B05D 3/0254* (2013.01)

(58) Field of Classification Search
CPC ..... B05D 5/005; B05D 3/0254
See application file for complete search history.

(56) References Cited

U.S. PATENT DOCUMENTS 6,827,969 B1 12/2004 Skoog et al.
6,890,587 B2 5/2005 Khan et al.
(Continued)

FOREIGN PATENT DOCUMENTS

EP 1471043 A2 10/2004
EP 1586676 A1 10/2005
(Continued)

OTHER PUBLICATIONS

Notice of Intent to Grant and Text Intended to Grant from counterpart European Application No. 19173482.1, dated Oct. 20, 2020, 35 pp.
(Continued)

*Primary Examiner* — Nathan T Leong
(74) *Attorney, Agent, or Firm* — Shumaker & Sieffert, P.A.

(57) ABSTRACT

In some examples, a method including applying a wet bond coat slurry to a damaged area of a coating system on a metal substrate, the bond coat slurry including a liquid binder, glass and/or glass-ceramic particles, and ceramic oxide particles; depositing fibers onto the wet bond coat slurry, wherein the fibers include metallic and/or ceramic fibers; applying a ceramic composite slurry on the bond coat while the bond coat is wet or at least partially dried to form a ceramic composite layer, the bond coat including a plurality of partially exposed fibers, wherein, following the application of the ceramic composite slurry, a first portion of fibers of the plurality of fibers are embedded in the bond coat and a second portion of fibers of the plurality of fibers extend into the layer of the ceramic composite slurry; and heating the bond coat and the ceramic composite layer to form a repaired portion of the coating system on the metal substrate, wherein heating the bond coat melts the glass particles and/or the glass-ceramic particles to form a fully amorphous
(Continued)

glass phase or a mixture of amorphous and crystalline glass phases which bond with the metal substrate.

13 Claims, 3 Drawing Sheets

(56) References Cited

U.S. PATENT DOCUMENTS

| | | | | |
|---|---|---|---|---|
| 6,919,121 | B2 | 7/2005 | Stowell et al. | |
| 7,476,703 | B2 | 1/2009 | Ruud et al. | |
| 7,687,150 | B2 | 3/2010 | Simendinger, III | |
| 7,842,335 | B2 | 11/2010 | Skoog et al. | |
| 8,173,206 | B2 * | 5/2012 | Boutwell | C04B 41/009 427/142 |
| 9,387,512 | B2 * | 7/2016 | Lee | C04B 41/85 |
| 9,845,411 | B2 | 12/2017 | Blohowiak et al. | |
| 2017/0145560 | A1 | 5/2017 | Weaver et al. | |

FOREIGN PATENT DOCUMENTS

| | | | |
|---|---|---|---|
| EP | 2062999 | A2 | 5/2009 |
| EP | 2141138 | A1 | 1/2010 |

OTHER PUBLICATIONS

Extended Search Report from counterpart European Application No. 19173482.1, dated Nov. 19, 2019, 5 pp.

* cited by examiner

SLURRY-BASED COATING SYSTEM REPAIR

This application claims the benefit of U.S. Provisional Patent Application Nos. 62/679,547, filed Jun. 1, 2018, and 62/827,584, filed Apr. 1, 2019, the entire content of each application is incorporated herein by reference.

TECHNICAL FIELD

The disclosure describes slurry-based coating techniques.

BACKGROUND

Mechanical structures and components may be exposed to high temperatures and environmental conditions that may lead to material degradation or damage. For example, certain mechanical structures and components associated with the combustion or power turbine sections of gas turbine engines such as turbine blades are subjected to temperatures up to 1300 degrees Celsius and have related environmental degradation mechanisms such as hot corrosion Improvements in efficiency and reductions in emissions have driven increased demands for higher gas turbine inlet and outlet temperatures, which in turn require technological improvements in cooling, materials, and coatings to achieve such higher temperatures. Components of high-temperature mechanical systems are often fabricated from a nickel superalloy substrate. In many examples, the substrates may be coated with one or more coatings to modify surface properties of the substrate. For example, a superalloy substrate may be coated with a thermal barrier coating to reduce heat transfer to the turbine blades performing the work, thereby increasing engine efficiency

SUMMARY

In some examples, the disclosure describes a method comprising applying a wet bond coat slurry to a damaged area of a coating system on a metal substrate, wherein the bond coat slurry comprises a liquid binder, at least one of glass particles or glass-ceramic particles, and ceramic oxide particles; depositing a plurality of fibers onto the wet bond coat slurry at least one of during or after the wet bond coat slurry is applied to the damaged area, wherein the plurality of fibers includes at least one of metallic fibers or ceramic fibers; applying a ceramic composite slurry on the bond coat to form a ceramic composite layer, wherein, during the application of the ceramic composite slurry on the bond coat, the bond coat is wet or at least partially dried, wherein the wet or at least partially dried bond coat includes a plurality of partially exposed fibers, wherein, following the application of the ceramic composite slurry, a first portion of individual fibers of the plurality of fibers are embedded in the wet or at least partially dried bond coat and a second portion of the individual fibers of the plurality of fibers extend into the layer of the ceramic composite slurry; and heating the wet or at least partially dried bond coat and the ceramic composite layer to form a repaired portion of the coating system on the metal substrate, wherein heating the bond coat melts at least a portion of the at least one of the glass particles or the glass-ceramic particles to form a fully amorphous glass phase or a mixture of amorphous and crystalline glass phases which bond with the metal substrate.

In some examples, the disclosure describes an assembly comprising a metal substrate; a coating system on the metal substrate; and a repaired portion of the coating system on the metal substrate. The repaired portion comprises a bond coat layer on the metal substrate, wherein the bond coat layer includes a glass or glass-ceramic including an amorphous glass phase and one or more crystalline ceramic phases bonded to the metal substrate, and one or more ceramic oxide phases, a ceramic composite layer, and a plurality of fibers, wherein the plurality of fibers includes at least one of metallic fibers or ceramic fibers, wherein a first portion of individual fibers of the plurality of fibers are embedded in the dried bond coat and a second portion of the individual fibers of the plurality of fibers extend into the ceramic composite layer.

The details of one or more examples are set forth in the accompanying drawings and the description below. Other features, objects, and advantages will be apparent from the description and drawings, and from the claims.

DETAILED DESCRIPTION

Figure 1:
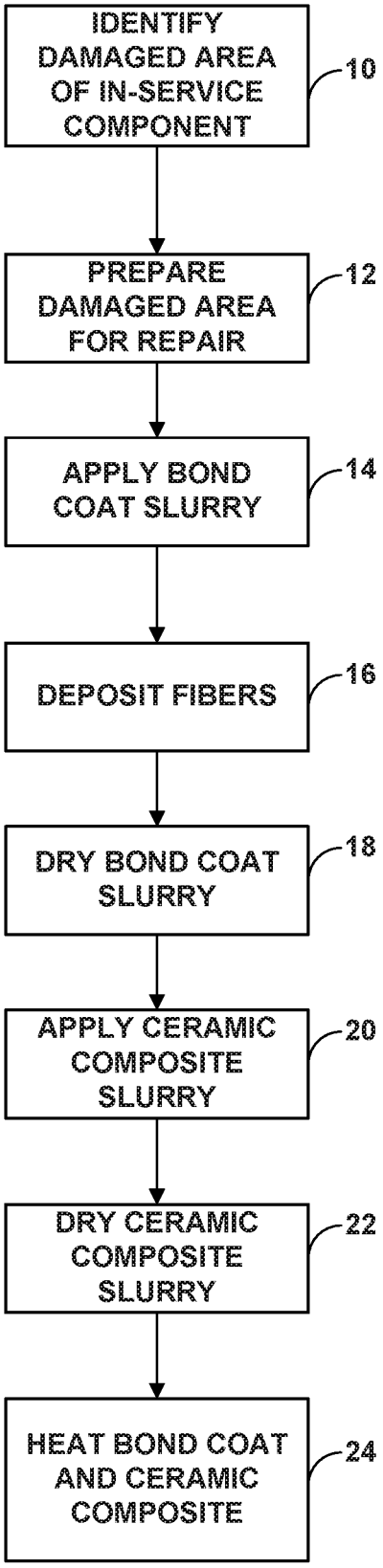
FIG. 1 is a flow diagram of an example technique for repairing a damaged coating system in accordance with some examples of the present disclosure.

In some examples, the disclosure relates to example techniques for repairing a coating system (e.g., a thermal barrier coating system or multifunctional coating system) and assembly including coating systems repaired using such techniques. In some examples, the repair techniques may be used for damaged coatings on an in-service component. An in-service or in-situ component may be one that is not removed from an assembly or from a normal operating configuration. An in-service component may remain in place during a coating restoration technique in some examples of the present disclosure.

In some examples, the component may be a component of a high temperature gas turbine engine. For example, the component may be an exhaust component such as, but not limited to an exhaust cone, exhaust duct, exhaust nozzle, or other structures that channel exhaust gases of an aircraft gas turbine engine. Such components may include a coating system that function as a thermal barrier coating that protects the underlying component substrate, e.g., by reducing heat transfer from the external environment to the substrate during high temperature operation. The coating repair technique may be employed on such an in-service component, e.g., when the gas turbine engine or at least the exhaust component of the gas turbine engine is located "on-wing" or otherwise still attached to the aircraft wing or inside the fuselage, e.g., rather than the component or entire turbine engine being removed from the aircraft for the repair process.

In some instance, methods and materials used in field repair patches for thick ceramic thermal barrier coatings on gas turbine exhaust components give inadequate service durability, frequently resulting in replacement with new components and associated cost. Concerns over fuel flammability for "on-wing" ceramic coating repairs dictate that techniques which impart high localized heating rates (e.g. welding, thermal spraying, laser etching, and the like) not be used for preparation of the exhaust component substrate surface to be repaired. Such restriction may limit the number of available solutions for in-situ (e.g., on-wing) repair of a high temperature ceramic coatings such as thermal barrier coating on exhaust components. No durable "on-wing" repair solutions for thick ceramic thermal barrier coatings appear to exist.

In accordance with some aspects of the disclosure, example techniques are described for repairing a coating system (e.g., a thermal barrier coating system or multifunctional barrier coating system) of an in-service component in the field while the component is on an aircraft. A bond coat slurry may be applied to the metal substrate in the area of the damaged coating system by, e.g., air spraying using high, volume low pressure (HVLP) equipment or other techniques that may be safely utilized in a flammable environment. Following the bond coat slurry application, metal fibers or other suitable fibers may be deposited onto the bond coat slurry layer before the slurry layer dries, e.g., while the slurry layer is still glossy and wet, such that the fibers are partially embedded into the bond coat slurry layer. The bond coat slurry layer and fibers may then be wet or at least partially dried, e.g., via air drying, followed by the application of a ceramic composite slurry onto the bond coat layer and fibers. The ceramic composite slurry may be applied by, e.g., air spraying using HVLP equipment or other techniques that may be safely utilized in a flammable environment, and then dried, e.g., via air drying. When dried, the deposited fibers may extend partially into the dried bond coat layer and partially into the dried ceramic composite layer to provide mechanical adhesion between the two layers. Alternatively, the bond coat may remain wet or partially dried when the ceramic composite layer is applied to enhance interlayer bonding The combination of the bond coat layer, with or without fibers, and ceramic composite layer then may be heated to form a ceramic thermal barrier layer adhered to the bond layer, which is adhered to the metal substrate. In some examples, the necessary heat may be supplied by engine exhaust when the component is an exhaust component of an on-wing gas turbine engine. The bond coat slurry includes glass particles (e.g., glass powder) that may be referred to as glass-ceramic powder in that upon melting, at least a portion of the glass particles crystallize in the bond coat when cooled. The glass particles may be mixed with ceramic oxide particles (e.g., MgO, $Al_2O_3$, or $MgAl_2O_4$ (spinel)) that remain unreacted during the glass particle melting and lend toughness to the bond coat layer matrix formed when the dried bond coat layer is heated. Once the bond coat has partially melted during the heating process and formed a bond with the metal substrate in the damaged area, the glass partially crystallizes to form a more stable phase so that it does not re-melt and spall after cooling and subsequent reheating. Alternatively, a vitreous glass with a suitably high CTE and high softening point may be used instead of a partially crystalline glass-ceramic as the sealing phase to the metal substrate. The components of the bond coat layer may have a coefficient of thermal expansion (CTE) between the CTE of the underlying metal substrate and that of the ceramic layer formed from the dried ceramic composite layer.

The bond coat slurry and the ceramic composite slurry may also include a liquid binder and transform to a solid via a sol-gel reaction (also referred to as a sol-gel process). For example, the bond coat slurry and the ceramic composite slurry may include a sol-gel ethyl polysilicate binder. The residual product of ethyl polysilicate after hydrolysis, condensation and pyrolysis is solid amorphous $SiO_xC_y$, with or without $SiO_2$ (where x and y depend upon pyrolysis temperature and partial pressures of $O_2$, and CO) which is substantially similar to glass $SiO_2$. The slurries may include an alkoxide catalyst for the sol-gel reaction, such as aluminum ethoxide, or other types of catalysts that enable solidification and drying the bond coat layer and ceramic composite layer after being air sprayed or otherwise deposited as a slurry.

Examples of the disclosure may provide one or more advantages which may be apparent from the description herein. For example, repair techniques are described including air spraying of a bi-layer sol-gel coating that is formulated to adhere metal substrate (e.g., after grinding) when heat is applied. Example of the slurry-based repair techniques for damaged thermal barrier coating or other coating systems may provide greatly reduced cost and time associated with field repair in comparison to repairs that include component replacement or removal/recoating of the component rather than on-wing repair. In comparison to other repair slurries, the slurry repair techniques of the disclosure may advantageously include a bond coat formulation that incorporates a glass-ceramic powder which enables adhesion of the thermal barrier coating or other coating system to metallic exhaust surfaces that are prepared by air or electric powered grinding tools available in the field. The glass ceramic may have a CTE engineered to accommodate high thermal expansion and contraction during thermal cycling against a metal substrate.

As another example, in comparison to other repair slurries techniques, examples of the disclosure may utilize a sol-gel ethyl polysilicate binder, which does not shrink as much as, e.g., a methylphenylsiloxane SR355 binder, after firing. For slurries that use methylphenylsiloxane SR355 or other highly organic functionalized silicone resin binders, sufficient shrinkage occurs during firing to service temperature that mudcracking may be visible in the finished repair patch. While some mudcracking is beneficial to thermal expansion and is anticipated from a material that starts as a liquid, dries to a solid and fires to a hard ceramic, the amount that occurs in a methylphenylsiloxane binder may be deleterious to long term structural integrity of the coating. In contrast, the reduced coating shrinkage afforded by ethyl polysilicate binder enables example repair patches of the disclosure to pyrolyze after air drying using engine exhaust heat since dried ethyl polysilicate has less organic content to vaporize during pyrolysis than SR355-based slurries to achieve an inorganic $SiO_2$ or $SiO_xC_y$ chemistry and structure. Moreover, the glass-ceramic and MgO in the bond coat matrix of some examples of the disclosure does not readily react during pyrolysis at service temperatures up to 816° C., instead exhibiting desirable thermal stability. Initial thermal stability was displayed in the test described below for samples subject to static thermal cycling for 554 hours.

FIG. 1 is a flow diagram illustrating an example technique to repair a coating system of the present disclosure. While examples of the disclosure are described primarily in the context of repairing coating systems that function as a thermal barrier coating system (such as coating system 32 in FIG. 2), the repair of other coating systems using the described techniques are contemplated. In some examples, the coating system may function to provide one or more of thermal protection, environmental protection, improved performance, and the like to an underlying substrate of a component. In some examples, the coating system may be a multifunctional coating system or multifunctional thermal barrier coating system. The coating system may be applied to a substrate of a component of a gas turbine engine, such as, e.g., an exhaust component of a gas turbine engine. However, other applications are contemplated.

The repair technique of FIG. 1 includes identifying a damaged area of a thermal barrier coating system on a substrate of an in-service component (10); preparing the damaged area for repair (12); applying a bond coat slurry (14); depositing metallic and/or ceramic fibers onto the surface of the bond coat slurry layer (16); at least partially drying the bond coat slurry (18); applying a ceramic composite slurry onto the applied bond coat layer and fibers (20); drying the ceramic composite slurry layer (22); and heating the dried bond coat and ceramic composite layer (24). While the coating repair technique is shown beginning with operation 10 in FIG. 1, in other examples the example technique may begin at various points in the repair technique of FIG. 1. Further, various examples may include some or all of the operations illustrated in FIG. 1, and the operations may or may not be performed in the illustrated order. Moreover, while the example technique of FIG. 1 includes the step of at least partially drying the bond coat slurry at least partially, e.g., partially drying or fully drying, in other examples, the ceramic composite slurry may be applied to the previously applied bond coat while the bond coat slurry is wet.

Figure 2:
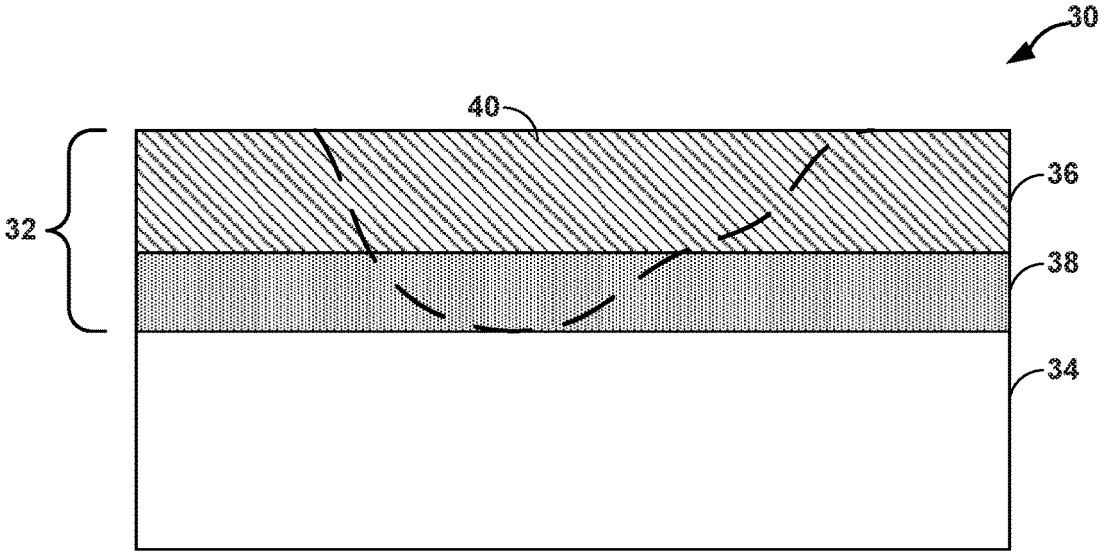
FIG. 2 is a schematic diagram of an example intact coating system on a substrate.

The coating repair technique of FIG. 1 may include identifying a damaged area of a thermal barrier coating on a substrate of an in-service component (10). FIG. 2 is a schematic diagram illustrating a surface cross-section an in-service component 30. An in-service or in-situ component may be one that is not removed from an assembly or from a normal operating configuration. An in-service component may remain in place during a coating repair technique in some examples of the present disclosure. In some examples, the component may be part of a high temperature mechanical system. For example, the component may be a component of the exhaust section of a gas turbine engine, such as, an exhaust cone, exhaust duct, or exhaust nozzle. The gas turbine engine may be mounted on an aircraft, such as, on a wing or in the fuselage. The repair technique may be performed on component 30 while the gas turbine engine is still mounted on the wing or in the fuselage of the aircraft. The repair technique may be considered as a field repair for such a gas turbine engine when the engine is mounted in an aircraft in a hanger. As noted above, the field repair of a thermal barrier coating on a component, such as, component 30, may prevent the use of some surface preparation techniques due to concerns over flammable fuel vapors in close proximity to the repair and risk of further damage to the engine exhaust duct. As will be apparent from the disclosure, techniques of the disclosure may allow for field repair of such coatings in spite of the fuel flammability concerns.

Component 30 includes multifunctional thermal barrier coating system 32 on substrate 34. Thermal barrier coating system 32 includes bond coat 38 and thermal barrier coating layer 36. Substrate 34 may include a material suitable for use in a high-temperature environment. In some examples, substrate 12 includes a superalloy including, for example, an alloy based on Ni, Co, or Fe. In some examples, substrate 34 may be a Ti or Ni alloy sheet. In examples in which substrate 34 includes a superalloy material, substrate 34 may also include one or more additives such as titanium (Ti), cobalt (Co), aluminum (Al), molybdenum (Mo), chromium (Cr), silicon, (Si), niobium (Nb), tantalum (Ta), and tungsten (W). which may improve the mechanical properties of substrate 12 including, for example, toughness, hardness, temperature stability, corrosion resistance, oxidation resistance, or the like.

As illustrated in FIG. 2, bond coat 38 of coating system 32 is on substrate 34. As used herein, "formed on" and "on" mean a layer or coating that is formed on top of another layer or coating, and encompasses both a first layer or coating formed immediately adjacent a second layer or coating and a first layer or coating formed on top of a second layer or coating with one or more intermediate layers or coatings present between the first and second layers or coatings. In contrast, "formed directly on" and "directly on" denote a layer or coating that is formed immediately adjacent another layer or coating, e.g., there are no intermediate layers or coatings. In some examples, as shown in FIG. 2, coating 38 of coating system 32 may be directly on substrate 34. In other examples, one or more coatings or layers of coatings may be between coating 38 of coating system 32 and substrate 34.

Thermal barrier coating layer 36 may be bonded or otherwise adhered to substrate 34 via bond coat 38. Bond coat 38 and thermal barrier coating layer 36 may have any suitable composition. Multifunctional thermal barrier coating (TBC) layer 36 may include a composition that provides thermal cycling resistance, low thermal conductivity, temperature resistance, erosion resistance, impact resistance and other properties including combinations thereof, or the like. In some examples, TBC layer 36 may include magnesium oxide (MgO), aluminum oxide ($Al_2O_3$), spinel ($MgAl_2O_4$) or other oxides. Also, multifunctional TBC layer 36 may include silicon alkoxide binders (e.g. tetraethylorthosilicate, trimethylsiloxysilicate, ethyl trisiloxane or tetramethylorthosilicate). TBC layer 36 may have improved thermal insulation, protection, thermal cycling resistance, or the like. Bond layer 38 may have a composition that includes of a wire arc or plasma-sprayed metal bond coat such as CoNiCrAlY or NiCrAlY. In some examples, bond layer 38 may be approximal 0.005 inches thick.

TBC system 32 may be any suitable thickness. In some examples, TBC system 32 may have a thickness of about 0.025 inches to about 0.090 inches. The thickness of bond coat 38 may be about 0.005 inches to about 0.010 inches. The thickness of TBC layer 36 may be about 0.020 inches to about 0.080 inches. Other thicknesses are contemplated.

Thermal barrier coating system 32 of component 30 may become damaged, e.g., during operation of a gas turbine engine. For example, in the case of a high temperature gas turbine engine on an aircraft, deleterious environmental species, such as, for example, CMAS or water vapor, may penetrate the TBC system 32 (e.g., through voids or porosity in the coating system). The presence of a deleterious environmental species in the TBC may weaken or degrade the TBC layers, resulting in spalling of the TBC from the substrate, which may expose the substrate to higher temperatures and environmental species. Portion 40 shown in FIG. 2 may represent a spalled portion of TBC system. Spalled portion 40 may be repaired, e.g., to prevent damage to substrate 34 during further operation. As described herein, examples of the disclosure may include on-wing, field repair of spalled portion 40 or other damaged portion of TBC system 32, in a flammable environment.

As shown in FIG. 1, the damaged area (e.g., spalled portion 40) of TBC system 32 may be identified (10) using any suitable technique, e.g., visual inspection, mechanical tapping with a probe or ultrasonic testing to evaluate the extent of delamination. Damage may be experienced on any portion of a component or system where a coating has been compromised and the substrate surface exposed to damaging conditions. Typically, the full thickness of the TBC will spall when damaged and the area of the damage can range from 10 $mm^2$ to 100 $cm^2$ or more. In some examples, the damaged area can also vary in area and depth from one portion of the damaged area to another. The size and location of a damaged area may influence further actions relating to repair of the component.

Figure 3:
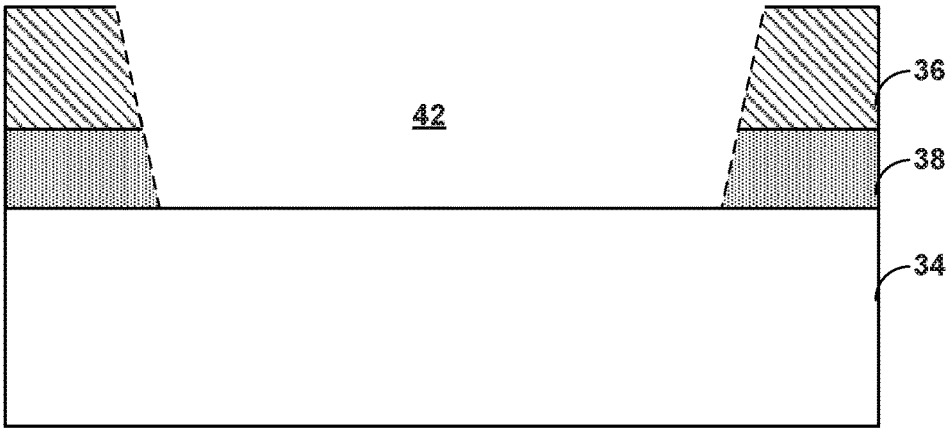
FIGS. 3-6 are schematic diagrams illustrating a damaged coating system on a substrate at various point in time during repair using the example repair technique illustrated in FIG. 1.

Once the damaged area is identified (10), the damaged area may be prepared for repair (12). FIG. 3 is a conceptual diagram illustrating spalled portion 40 (FIG. 2) after being prepared for repair, leaving prepared portion 42 in TBC coating 32. Preparing the damaged area for repair may include removing damaged material from the surface of substrate 34, cleaning the surface of substrate 34, roughening the surface of substrate 34, masking the surface of substrate 34, and combinations thereof.

In some examples, removing the damaged area results in exposing the substrate. The removal may be accomplished using any suitable technique including, e.g., a rotary grinding hand tool or other fixed abrasive surface finishing process. Cleaning the surface of substrate 34 may include removing contaminants from the exposed surface or surfaces. Cleaning techniques may include, for example, a solvent wash-type cleaning technique, a mechanical abrasion-type cleaning technique, and combinations thereof. In some examples, cleaning the surface of substrate 34 may remove contaminants without removing uncompromised coating and/or substrate material.

Roughening the exposed surface of substrate 34 may include, for example, using abrasive papers or pads, grinding with a rotary tool, grit blasting, and combinations thereof to roughen the exposed surface. Roughening of an exposed surface may improve the ability of the repair coating to adhere to the surface of substrate 34 compared to a surface that has not been roughened. Any type of finishing process which creates an undercut surface favors mechanical adhesion of the coating to the substrate.

When using a fixed abrasive grinding tool or other tool to prepare the surface, care may be taken to not damage the undamaged portion of the thermal barrier coating system 32. The amount of residual coating left after preparation of the damaged portion should be minimal and the metal substrate may be ground to a uniform appearance.

Masking portions of the component surface may include masking portions of the component that are undamaged, leaving the damaged area uncovered. Whether the repair technique includes masking portions of the component surface and the extent and type of masking, if used, may depend upon the type of restoration coating material, how restoration coating material is applied, the geometry of the damaged or undamaged areas, the location of the damaged area, etc. Heavy duty thermal spray masking tape is a durable option for this repair process.

Figure 4:
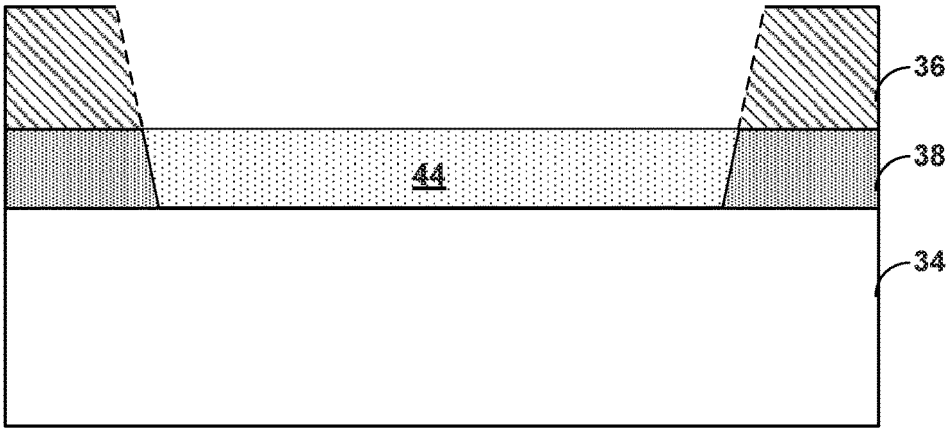
Figure 5:
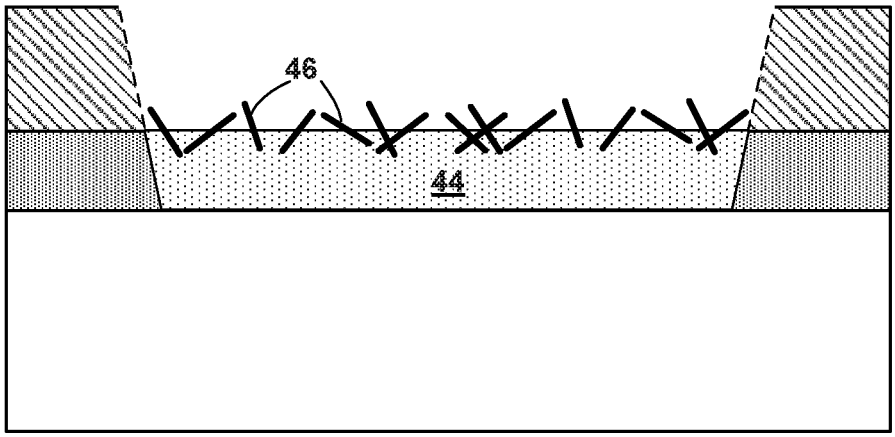
Figure 6:
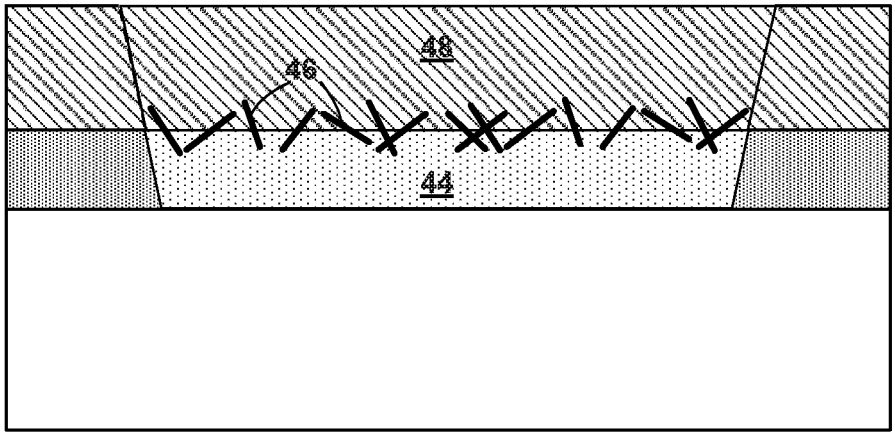

As shown in FIG. 3, after preparing the damaged area of component 30, the prepared portion 42 may expose substrate 42. Following the preparation, a bond coat slurry may be applied to the exposed portion of substrate 34 to form a bond coat layer 44 on substrate 34 (as shown in FIG. 4). As described herein, the applied bond coat slurry may be result in a glass-ceramic composite layer on the exposed surface of substrate 34 which may be applied, e.g., by air spraying using HVLP spray equipment, painting, or other suitable technique. The bond coat slurry may be applied in-situ or on-site, or at another location, e.g., after removing the component from its assembly. The resulting wet thickness of bond coat layer 44 may be from about 0.005 inches to about 0.020 inches, and may be approximated visually or using a mechanical thickness gage.

Following the deposition of the bond coat slurry to form bond coat layer 44, a plurality of fibers 46 may be deposited onto the surface of bond coat layer 44 (16). Fibers 46 may be metal alloy fibers, such as Ni-based fibers, or chopped ceramic fibers such as Nextel 720, and may be deposited prior to the drying of bond coat layer 44, e.g., while the bond coat layer 44 is still glossy wet. In this manner, a portion of individual fibers 46 may extend into bond coat layer 44 while another portion of the individual fibers 46 may extend out of the bond coat layer 44. Alternatively, no fibers may be applied to the wet bond coat. When bond coat layer 44 is still wet or partially dried and a ceramic composite slurry is deposited to form ceramic composite layer 48, a portion of an individual fiber 46 may extend into the dried bond layer 44 with another portion of the individual fiber 46 extending into the ceramic composite layer 48. In such a configuration, the wet bond coat interface with the ceramic composite layer may provide a chemical bond while fibers 46 may provide a mechanical bond between bond coat layer 44 and ceramic composite layer 48.

Fibers 46 may be deposited using any suitable technique (16). When the surface of bond coat layer 44 is facing "up," fibers 46 may be deposited by uniformly sprinkling or sifting fibers 46 by hand or other device over the surface and allowing gravity to embed fibers 44 into bond coat layer 44. If the surface of bond coat layer 44 is facing "down" or otherwise not allowing for gravity to deposit fibers 46 (e.g., in a vertical or inverted orientation), air pressure may be used to propel the fibers, e.g., from a paper cup or other holding device, towards the "wet" bond coat layer 44 with enough force to attach fibers 46 to bond coat layer 44 and allow surface tension of the liquid binder to partially envelop and embed the fibers 46 in bond coat layer 44.

In one example, a paper cup and air hose in a hole in the bottom of the cup may be utilized. The cup may be partly filled with the metal fibers. The metal fibers contact and stick to the wet bond coat by pulsing air from the bottom of the cup. The open end of the cup may cover the wet bond coated surface. Several pulses of pressurized air may be applied until desired fiber coverage occurs.

Fibers 46 may have any suitable size and composition. For example, fibers 46 may have a diameter of about 10 microns to about 50 microns and a length of about 0.5 mm to about 4 mm, although other values are contemplated. When metal or ceramic fibers are used, the fibers should be chemically inert in the oxidizing environment and have creep resistance to the maximum temperature of the multifunctional repair thermal barrier coating, which is approximately 900° C.

Following the deposition of fibers 46 on bond layer 44 (16), bond layer 44 may be wet, fully dried or partially dried to maintain a tacky surface which enables chemical bonding to the composite ceramic layer (46) (18). Bond coat layer 44 may remain wet, dried or partially dried using active or passive techniques. In some examples, bond coat layer 44 may simply left out in ambient conditions (e.g., about 25 degrees Celsius and about one atmosphere pressure) for one or more hours or days. In other examples, elevated temperature may be used to increase the rate of drying of bond coat layer 44. The drying of bond coat layer 44 may cause reactions such as hydrolysis (reaction with atmospheric moisture or intentionally added water) and evaporation of ethanol as a byproduct of the sol-gel reaction. In some examples, the bond coat slurry may be dried (18) in air. In some examples, the bond coat slurry may be dried (18) at temperatures up to about 100 degrees Celsius. The dried thickness of bond coat layer 44 may be from about 0.005 inches to about 0.020 inches.

The bond coat layer 44 may remain wet or is dried (e.g., leaving a "fuzzy" dried bond coat layer 44) either partially or fully. Then, a ceramic composite slurry may be applied to the surface of bond coat layer 44 and the exposed portions of fibers 46 (20) to form ceramic composite layer 48. The ceramic composite slurry may be deposited using any suitable technique, which may be the same or different technique used to deposit the bond coat slurry. In some examples, the ceramic composite slurry may be applied, e.g., by air spraying using HVLP spray equipment, painting, or other suitable technique. In some examples, the application techniques may be compatible with use in a flammable fluids environment, e.g., to allow for on-wing repair of an exhaust component or other component of an aircraft gas turbine engine. The resulting wet thickness of ceramic composite layer 48 may be from about 0.020 inches to about 0.080 inches.

Following the deposition of the ceramic composite slurry to form ceramic composite layer 48, ceramic composite layer 48 may be dried (22), e.g., using one or more of the techniques described above with regard to drying of bond coat layer 44. The drying of ceramic composite layer 48 may cause reactions such as hydrolysis (reaction with atmospheric moisture or intentionally added water) and evaporation of ethanol as a byproduct of the sol-gel reaction. The dried thickness of ceramic composite layer 48 may be from about 0.020 inches to about 0.080 inches.

Once ceramic composite layer 48 has been dried (22), any masking may be removed and the combination of dried bond coat layer 44, fibers 46, and ceramic composite layer 48 may be heated (24). As will be described further below, the heating may be configured to melt components of the dried bond coat layer 44 and/or ceramic composite layer 48 or otherwise cause reactions within the dried layers. In some examples, dried bond coat layer 44, fibers 46, and ceramic composite layer 48 may be heated to a temperature greater than approximately 800 degrees Celsius such as, e.g., approximately 900 degrees Celsius.

The heating may be accomplished using any suitable technique. In the case of a component that has been disassembled and is not on-wing, the dried bond coat layer 44, fibers 46, and ceramic composite layer 48 may be heated in an air atmosphere furnace or other suitable heating apparatus. Advantageously, in other examples in which the component is still on-wing during the repair, the heat from the gas turbine engine may be sufficient to pyrolyze dried bond coat layer 44, fibers 46, and ceramic composite layer 48 as desired. For example, in the case of an exhaust component, the exhaust gas of the gas turbine engine may provide enough heat to heat dried bond coat layer 44, fibers 46, and ceramic composite layer 48 to cause the desired melting, and reaction between the adhesive glass bond coat and ceramic composite layer so that no additional heating is required. The exhaust heating profile during engine start-up, idling, and takeoff pyrolyzes the repaired ceramic composite coating for service. Alternatively, a similar process is performed on an exhaust duct component that is removed for coating repair, where instead of engine heating, the component is processed in an air atmosphere furnace using a time-temperature profile that pyrolyzes the repair coating.

The composition of the bond coat slurry may be formulated and processed to provide for a desired bond layer 44 when the repair technique of FIG. 1 is employed. Bond layer 44 is formulated and processed to adhere to the outer surface of substrate 34 while also adhering to ceramic composite layer 48. In some examples, the bond coat slurry includes glass particles and/or glass-ceramic particles ceramic oxide particles, and a liquid binder. The glass particles may be in the form of a powder and may be referred to as glass-ceramic particles in that at least a portion of the glass particles melt and crystallize during heating (24) of the applied bond coat 44. Once the bond coat has partially melted and formed a bond with the metal surface, the glass partially crystallizes so that it does not re-melt and spall after cooling and subsequent reheating (e.g., during operation of the gas turbine engine). Suitable glass-ceramic compositions for adhesion include Ba—Ca—Si—B—Al (e.g. Ferro EG 3118), Si—Al—$R_2O$—B (e.g. Ferro EG 2840) or Ba—Si—Al—Mg—B (e.g. Schott G018-311) or Ba—Sr—Ca—Si—Al—Mg—B (e.g. Schott G018-340). Vitreous glasses which may also be adapted for adhesion to metals include Corning 9013 alkali barium glass. The glass particles and/or glass-ceramic particles of the bond coat slurry may have a diameter of about 3 microns to about 50 microns.

In some examples, the glass-ceramic powder component of the bond coat slurry may be designed to seal by vitreous melting, partially crystalize, and thermally cycle against a $Y_2O_3$—$ZrO_2$, substrate surface. In this coating system, this type of glass-ceramic powder may be adapted to adhere to a metallic substrate with a higher CTE. For example, the processed solid glass-ceramic may have a CTE of about 9.9 to $12.4\times10^{-6}$/degree Celsius while an Inconel 625 substrate may have a CTE of about $12.3\times10^{-6}$/degree Celsius. In the bond coat slurry, the glass particles may have a melting temperature of, e.g., about 800 degrees Celsius to about 850 degrees Celsius, and may bond to the prepared (e.g., grounded) surface of metal substrate. When the glass particles and/or glass ceramic particles are melted during the heating, at least a portion of the glass particles and/or glass ceramic particles form a fully amorphous glass phase or a mixture of amorphous and crystalline glass phases which bond with the metal substrate. The bond with the metal substrate may be a chemical bond between the metal substrate and amorphous glass phase or a mixture of amorphous and crystalline glass phases of the bond coat. In some example, the chemical bond is formed with oxide(s) on the surface of the metal substrate.

The ceramic oxide particles of the bond coat slurry may be in the form of a powder (e.g., mixed with the glass particles) and may configured to remain unreacted, at least partially, during the melting of the glass particles during the heating step (24). The unreacted ceramic oxide particles may increase the toughness of the bond coat matrix to enable higher thermal strain accommodation, e.g., compared to glass or glass-ceramic alone. Suitable ceramic oxides in the bond coat slurry include MgO (magnesium oxide), $Al_2O_3$ (aluminum oxide) and $MgAl_2O_4$ (spinel). The ceramic oxide particles may have a size of about 1 micron to about 40 microns.

The liquid binder of the bond coat slurry may be prehydrolyzed ethyl polysilicate. Prehydrolyzed ethyl polysilicate may be liquid tetraethylorthosilicate (TEOS) with added acid, water, and ethanol to enable solidification and drying, e.g., upon exposure to air with a suitable amount of humidity, during the drying of the bond coat slurry (18). The ethyl polysilicate may undergo sol-gel reactions of hydrolysis and condensation to form amorphous SiOC (silicon oxycarbide) and/or $SiO_2$ (silicon dioxide). For example, after drying bond coat layer 44, e.g., in air (14) and heating (24), the residual product of the ethyl polysilicate is amorphous SiOC and or/$SiO_2$ which is reasonably similar to glass $SiO_2$.

The bond coat slurry may also include a catalyst for the sol-gel reaction. For example, the bond coat slurry may include aluminum ethoxide $Al(OC_2H_5)_3$ that acts as a catalyst for the sol-gel reaction of the bond coat slurry that enables solidification and drying of bond coat layer 44, e.g., using the example technique of FIG. 1.

In some examples, the bond coat slurry includes about 20 wt % to about 40 wt % glass powder, about 5 wt % to about 60 wt % ceramic oxide powder, about 10 wt % to about 25 wt % liquid sol-gel binder, and about 0.5 wt % to about 5 wt % catalyst, although other ranges are contemplated. In some examples, the bond coat slurry includes about 30 wt % to about 70 wt % glass powder, about 5 wt % to about 30 wt % ceramic oxide powder, about 20 wt % to about 40 wt % liquid sol-gel binder, and about 0.5 wt % to about 5 wt % catalyst, although other ranges are contemplated.

In some examples, the bond coat slurry composition provides for bond coat 44 that enables adhesion of ceramic composite thermal barrier layer 48 to the surface of underlying metal substrate 34 with limited mechanical surface preparation such as that by simple electric or air powered grinding tools when repairing a damaged portion thermal barrier coating system 32. All or substantially all of the components of the bond coat slurry may have a CTE that is similar to the CTEs of metal substrate 34 and ceramic composite layer 48.

The composition of the ceramic composite slurry may be formulated to provide for a desired multifunctional thermal barrier layer that is adhered to metal substrate 34 via bond coat 44 and fibers 46 when the repair technique of FIG. 1 is employed. In some examples, the ceramic composite slurry may include components that provide for a silicate-based thermal barrier layer. For example, similar to that of the bond coat slurry, the liquid binder of the ceramic composite slurry may be prehydrolyzed ethyl polysilicate, which forms amorphous SiOC and/or $SiO_2$ after drying (22) and/or heating (24) of the ceramic composite slurry. Also like that of the bond coat slurry, the ceramic composite slurry may also include a catalyst for the sol-gel reaction. For example, the ceramic composite slurry may include aluminum ethoxide $Al(OC_2H_5)_3$ that acts as a catalyst for the sol-gel reaction of the ceramic composite slurry that enables solidification and drying of ceramic composite layer 48, e.g., using the example technique of FIG. 1.

The ceramic composite slurry may also include ceramic oxide particles (e.g., $Al_2O_3$ and/or MgO and/or $MgAl_2O_4$), which may be in powder form. For plasma sprayed thermal barrier coatings, $ZrO_2$ is used because of its low thermal conductivity (2.0 W/m·K) and high CTE ($10\times10^{-6}$/degree Celsius) at temperatures up to 1300 degrees Celsius. However, in air sprayable silicate-based thermal barrier coatings such as ceramic composite layer 48, $ZrO_2$ may not desirable since it forms low strength $ZrSiO_4$ when reacted with silica that is unsuitable in an engine exhaust environment. In silicate-based thermal barrier slurries, MgO, $Al_2O_3$ and $MgAl_2O_4$ form stronger matrix structures than $ZrO_2$ and have adequate CTEs in spite of their higher thermal conductivities (approximately 45 W/m·K, 35 W/m·K, and 10 W/m·K, respectively).

The ceramic composite slurry may also include reinforcing fibers, such as ceramic or ceramic composite fibers to increase the cohesion strength of air sprayable ceramic composite layer 48. The reinforcing fibers may remain thermally stable at service temperatures of the component with in operation, e.g., when component 30 is a component of a gas turbine engine exhaust system of an aircraft.

In some examples, the ceramic composite slurry includes about 10 wt % to about 25 wt % reinforcement fiber, about 30 wt % to about 60 wt % ceramic oxide powder, about 15 wt % to about 40 wt % liquid, sol-gel binder, and about 0.5 wt % to about 5 wt % catalyst, although other ranges are contemplated. In some examples, the ceramic composite slurry includes about 5 wt % to about 15 wt % reinforcement fiber, about 40 wt % to about 70 wt % ceramic oxide powder, about 20 wt % to about 40 wt % liquid, sol-gel binder, and about 0.5 wt % to about 5 wt % catalyst, although other ranges are contemplated.

While the coating repair technique has been illustrated and described in detail in the drawings and foregoing description, the same is to be considered as illustrative and not restrictive in character, it being understood that only some examples have been shown and described, and that all changes and modifications that come within the scope of the following claims are desired to be protected.

It should be understood that while the use of words such as preferable, preferably, preferred or more preferred utilized in the description above indicate that the feature so described may be more desirable, it nonetheless may not be necessary and examples lacking the same may be contemplated as within the scope of the disclosure, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Example

Thermal cycling was performed to evaluate the thermomechanical stability of one or more aspects of examples of the disclosure, as described below. However, the disclosure is not limited by the testing or the corresponding description.

Three samples were prepared for the experiment by grinding away a thermal barrier coating down to the metal substrate, to create a simulated area of spalled coating. After grinding, the bond coat was air sprayed, followed by fiber infiltration to the wet bond coat and drying for 3 hours. Next, the ceramic composite layer was air sprayed, followed by drying for 12 hours and pyrolysis in an air furnace at 816° C. (1500° F.) for 4 hours. Each sample included a multifunctional thermal barrier coating system on an INCONEL nickel chromium alloy 625 substrate (Special Metals Corp., New Hartford, New York, N.Y. USA). The bond coat of the multifunctional thermal barrier coating system included G018-311 glass (Schott AG, Landshut, Germany), Dynasylan Silbond H-25 ethyl polysilicate (Evonik Industries), −325 mesh magnesium oxide (Materion Corp., Mayfield Heights, Ohio, USA) and aluminum ethoxide (Sigma Aldrich, St. Louis, Mo., USA.), and the ceramic thermal barrier layer on the bond coat included Nextel 720 chopped fiber (3M Company, Maplewood, Minn., USA), Dynasylan Silbond H-25 ethyl polysilicate, SM-8 aluminum oxide (Baikowski International Corp., Charlotte, N.C., USA) and aluminum ethoxide. A portion of the thermal barrier coating was removed down to the substrate, and the surface of the Inconel 625 substrate was prepared by using a Dremel tool grinding bit.

The compositions of the bond coat slurry and fired bond coat (Tables 1A and 1B) thermal barrier layer slurry example 1 (or ceramic composite slurry) and thermal barrier layer slurry example 2 (Tables 2A and 2B and Tables 3A and 3B) used for the repair, along with various properties of the components in each slurry, are listed below. All of the slurry compositions are presented as weight percentage of the raw materials. The fired bond coat and fired thermal barrier coatings are presented as weight percentage of chemical phases determined by powder x-ray diffraction

TABLE 1A

Composition of Bond Coat Slurry

| Component | Wt. % | CTE | E(GPa) |
|---|---|---|---|
| Ceramic glass powder | 52.6 | 9.9-12.4 × $10^{-6}$/° C. | 68 |
| Prehydrolyzed ethyl polysilicate | 28 | Not applicable (liquid) | 73 |
| −325 mesh MgO powder | 17.5 | 9-12 × $10^{-6}$/° C. | 250 |
| Aluminum ethoxide | 1.7 | Not found | Not found |

TABLE 1B

Composition of Fired Bond Coat

| Component | Wt. % | CTE |
|---|---|---|
| MgO | 56.0 | 9-12 × $10^{-6}$/° C. |
| Barium Silicate $BaSi_2O_5$ | 20.2 | 12.9 × $10^{-6}$/° C. |
| Barium Silicate $Ba_2(Si_4O_{10})$ | 23.8 | 13-15 × $10^{-6}$/° C. |
| Barium Silicon Oxide $Ba_5(Si_8O_{21})$ | <1 | 14.5 × $10^{-6}$/° C. |
| Barium Dialumodisilicate $Ba(Al_2Si_2O_8)$ (paracelsian) | <1 | 8 × $10^{-6}$/° C. |
| Barium Aluminum Silicate $BaAl_2Si_2O_8$ (celsian) | <1 | 8 × $10^{-6}$/° C. |
| Barium Magnesium Silicate $BaMg_2Si_2O_7$ | <1 | Not found |

TABLE 2A

Composition of Thermal Barrier Layer Slurry Example 1

| Component | Wt. % | CTE | E(GPa) |
|---|---|---|---|
| Nextel 720 fiber, 10,000 denier, chopped 0.5-1.0 mm long | 9.1 | 6 × $10^{-6}$/° C. | 250 |
| Prehydrolyzed ethyl polysilicate | 27.4 | 0.55 × $10^{-6}$/° C. (glass $SiO_2$) | 73 |
| −325 mesh $MgAl_2O_4$ powder | 62 | 9.0 × $10^{-6}$/° C. | 240 |
| Aluminum ethoxide | 1.5 | Not applicable | Not applicable |

TABLE 2B

Composition of Fired Thermal Barrier Layer Example 1

| Component | Wt. % | CTE | E(GPa) |
|---|---|---|---|
| Spinel - $MgAl_2O_4$ | 88.4 | 9.0 × $10^{-6}$/° C. | 240 |
| Mullite - $Al_2O_3$•$SiO_2$ | 7.8 | 5.4 × $10^{-6}$/° C. | 151 |
| α Alumina - $Al_2O_3$ | 3.8 | 8.5 × $10^{-6}$/° C. | 228 |

TABLE 3A

Composition of Thermal Barrier Layer Slurry Example 2

| Component | Wt. % | CTE | E(GPa) |
|---|---|---|---|
| Nextel 720 fiber, 10,000 denier, chopped 0.5-1.0 mm long | 12.2 | 6 × $10^{-6}$/° C. | 250 |
| Prehydrolyzed ethyl polysilicate | 36.7 | 0.55 × $10^{-6}$/° C. (glass $SiO_2$) | 73 |

TABLE 3A-continued

Composition of Thermal Barrier Layer Slurry Example 2

| Component | Wt. % | CTE | E(GPa) |
|---|---|---|---|
| −325 mesh $Al_2O_3$ powder | 49 | 8.5 × $10^{-6}$/° C. | 228 |
| Aluminum ethoxide | 2.0 | Not applicable | Not applicable |

TABLE 3B

Composition of Fired Thermal Barrier Layer Example 2

| Component | Wt. % | CTE | E(GPa) |
|---|---|---|---|
| α Alumina - $Al_2O_3$ | 87.8 | 8.5 × $10^{-6}$/° C. | 228 |
| Mullite - $Al_2O_3$•$SiO_2$ | 12.2 | 5.4 × $10^{-6}$/° C. | 151 |
| Silicon Oxide - $SiO_2$ | <1 | 7.2 × $10^{-6}$/° C. (para) | 97.2 (parallel) |
| | | 13.2 × $10^{-6}$/° C. (perp.) | 76.5 (perpendicular) |

The damaged portion of the thermal barrier coating system of each sample was repaired by depositing the bond coat slurry using HVLP air spraying and then depositing 10 micrometer (μm) diameter by 1 millimeter (mm) long HASTELLOY X fibers (available from IntraMicron, Inc, Auburn, Ala. USA) onto the wet bond coat slurry such that a portion of the fibers protruded from the bond coat slurry and another portion of the fibers extended out of the wet slurry layer. The wet bond coat slurry was then dried in air at 72° F. for 3 hours. The ceramic composite slurry was then deposited onto the dried bond coat layer and then dried in air at 72° F. for 12 hours. The combination of the dried bond coat layer and dried ceramic composite layer was then heated by inserting into an air atmosphere furnace at 816° C. (1500° F.) for 4 hours followed by air cooling. The resulting bond layer had a thickness of approximately 0.010 inches and the resulting ceramic composite layer has a thickness of approximately 0.060 inches for each sample.

Each of the three prepared samples having repaired thermal barrier coating system underwent thermal cycling testing. Each thermal cycle included exposing the sample to approximately 1500 degrees Fahrenheit for 50 minutes followed by 10 minutes of fan cooling. For each sample, the coating, including the repaired portion, remained well adhered to the metal substrate after 554 hours (or 554 thermal cycles). Additionally, the microstructure of the bond coat exhibited wholly unreacted MgO in the ceramic-glass-MgO composite layer, suggesting that the bond coat matrix was thermally stable after 554 hours of thermal cycling.

The CTE and elastic modulus (E) for each component are listed in Table 1 show that the MgO and glass-ceramic components of the bond coat have CTE values similar to those of the ceramic composite coating and the Inconel 625 substrate between which the bond coat was applied. With the exception of the ethyl polysilicate, which pyrolyzes into amorphous SiOC and/or $SiO_2$, the moduli and CTEs are tailored to accommodate a ceramic composite coating with a CTE ranging from 8-13×$10^{-6}$/degree Celsius.

Various examples have been described. These and other examples are within the scope of the following clauses and claims.

Clause 1. A method comprising applying a wet bond coat slurry to a damaged area of a coating system on a metal substrate, wherein the bond coat slurry comprises a liquid binder, at least one of glass particles or glass-ceramic particles, and ceramic oxide particles; depositing a plurality of fibers onto the wet bond coat slurry at least one of during or after the wet bond coat slurry is applied to the damaged area, wherein the plurality of fibers includes at least one of metallic fibers or ceramic fibers; applying a ceramic composite slurry on the bond coat to form a ceramic composite layer, wherein, during the application of the ceramic composite slurry on the bond coat, the bond coat is wet or at least partially dried, wherein the wet or at least partially dried bond coat includes a plurality of partially exposed fibers, wherein, following the application of the ceramic composite slurry, a first portion of individual fibers of the plurality of fibers are embedded in the wet or at least partially dried bond coat and a second portion of the individual fibers of the plurality of fibers extend into the layer of the ceramic composite slurry; and heating the wet or at least partially dried bond coat and the ceramic composite layer to form a repaired portion of the coating system on the metal substrate, wherein heating the bond coat melts at least a portion of the at least one of the glass particles or the glass-ceramic particles to form a fully amorphous glass phase or a mixture of amorphous and crystalline glass phases which bond with the metal substrate.

Clause 2. The method of clause 1, wherein the liquid binder of the bond coat slurry comprises at least one of an ethyl polysilicate binder or other silicon alkoxide binder.

Clause 3. The method of clause 2, wherein the ceramic composite slurry applied to the at least partially dried bond coat comprises the at least one of the ethyl polysilicate binder or other silicon alkoxide binder.

Clause 4. The method of any of clauses 1-3, wherein the at least one of glass particles or glass-ceramic particles comprise glass-ceramic powder.

Clause 5. The method of clause 4, wherein the glass-ceramic powder comprises at least one of Ba—Ca—Si—B—Al, Si—Al—$R_2O$—B, Ba—Si—Al—Mg—B, or Ba—Sr—Ca—Si—Al—Mg—B.

Clause 6. The method of any of clauses 1-5, wherein the bond coat slurry comprises a catalyst for a sol-gel reaction of the bond coat.

Clause 7. The method of any of clauses 1-6, wherein the ceramic oxide particles comprise at least one of MgO, $Al_2O_3$, or $MgAl_2O_4$ particles.

Clause 8. The method of any of clauses 1-7, wherein the metal substrate comprises the metal substrate of an in-service component.

Clause 9. The method of clause 8, wherein the in-service component comprises an exhaust component of a gas turbine engine mounted to an aircraft.

Clause 10. The method of clause 9, wherein heating the dried bond coat and the ceramic composite slurry layer to form a repaired portion of the thermal barrier coating system on the metal substrate comprises heating the dried bond coat and the ceramic composite slurry layer via exhaust gas of the gas turbine engine.

Clause 11. The method of any of clauses 1-10, wherein at least a portion of the ceramic oxide particles remain unreacted following the heating of the dried bond coat and the ceramic composite slurry layer.

Clause 12. The method of any of clauses 1-11, wherein the metal substrate comprises a nickel superalloy, a cobalt superalloy, or a titanium alloy.

Clause 13. The method of any of clauses 1-12, further comprising leaving the in-service component as part of an assembly of which the in-service component is a part throughout the method of clause 1.

Clause 14. An assembly comprising a metal substrate; a coating system on the metal substrate; and a repaired portion of the coating system on the metal substrate, the repaired portion comprising a bond coat layer on the metal substrate, wherein the bond coat layer includes a glass or glass-ceramic including an amorphous glass phase and one or more crystalline ceramic phases bonded to the metal substrate, and one or more ceramic oxide phases, a ceramic composite layer, and a plurality of fibers, wherein the plurality of fibers includes at least one of metallic fibers or ceramic fibers, wherein a first portion of individual fibers of the plurality of fibers are embedded in the dried bond coat and a second portion of the individual fibers of the plurality of fibers extend into the ceramic composite layer.

Clause 15. The assembly of clause 14, wherein the ceramic composite layer includes at least one of amorphous SiOC or $SiO_2$ and at least one of MgO, $Al_2O_3$, or $MgAl_2O_4$.

Clause 16. The assembly of any of clauses 14 or 15, wherein the bond coat layer includes at least one of amorphous SiOC or amorphous $SiO_2$.

Clause 17. The assembly of any of clauses 14-16, wherein the ceramic oxide phase of the bond coat comprises at least one of MgO, $Al_2O_3$ or $MgAl_2O_4$.

Clause 18. The assembly of any of clauses 14-17, wherein the plurality of fibers comprises a plurality of nickel-based fibers or ceramic fibers.

Clause 19. The assembly of any of clauses 14-18, wherein the metal substrate comprises a nickel superalloy, a cobalt superalloy, or a titanium alloy.

Clause 20. The assembly of any of clauses 14-19, wherein the metal substrate comprises a metal substrate of an in-service component, and the in-service component comprises an exhaust component of a gas turbine engine mounted to an aircraft.

Clause 21. A method comprising applying a wet bond coat slurry to a damaged area of a coating system on a metal substrate, wherein the bond coat slurry comprises a liquid binder, at least one of glass particles or glass-ceramic particles, and ceramic oxide particles; depositing a plurality of fibers onto the wet bond coat slurry at least one of during or after the wet bond coat slurry is applied to the damaged area, wherein the plurality of fibers includes at least one of metallic fibers or ceramic fibers; drying the bond coat slurry to form an at least partially dried bond coat on the metal substrate, wherein the at least partially dried bond coat includes a plurality of partially exposed fibers; applying a ceramic composite slurry on the at least partially dried bond coat to form a ceramic composite layer, wherein, following the application of the ceramic composite slurry, a first portion of individual fibers of the plurality of fibers are embedded in the at least partially dried bond coat and a second portion of the individual fibers of the plurality of fibers extend into the layer of the ceramic composite slurry; and heating the at least partially dried bond coat and the ceramic composite layer to form a repaired portion of the coating system on the metal substrate, wherein heating the dried bond coat melts at least a portion of the at least one of the glass particles or the glass-ceramic particles to form a fully amorphous glass phase or a mixture of amorphous and crystalline glass phases which bond with the metal substrate.

Clause 22. The method of clause 21 in combination with one or more of clauses 2 to 13.

What is claimed is:

1. A method comprising:

applying a wet bond coat slurry to a damaged area of a coating system on a metal substrate, wherein the bond coat slurry comprises a liquid binder, at least one of glass particles or glass-ceramic particles, and ceramic oxide particles;

depositing a plurality of fibers onto the wet bond coat slurry at least one of during or after the wet bond coat slurry is applied to the damaged area, wherein the plurality of fibers includes at least one of metallic fibers or ceramic fibers;

applying a ceramic composite slurry on the bond coat to form a ceramic composite layer, wherein, during the application of the ceramic composite slurry on the bond coat, the bond coat is wet or at least partially dried, wherein the wet or at least partially dried bond coat includes a plurality of partially exposed fibers, wherein, following the application of the ceramic composite slurry, a first portion of individual fibers of the plurality of fibers are embedded in the wet or at least partially dried bond coat and a second portion of the individual fibers of the plurality of fibers extend into the layer of the ceramic composite slurry; and heating the wet or at least partially dried bond coat and the ceramic composite layer to form a repaired portion of the coating system on the metal substrate, wherein heating the bond coat melts at least a portion of the at least one of the glass particles or the glass-ceramic particles to form a fully amorphous glass phase or a mixture of amorphous and crystalline glass phases which bond with the metal substrate.

2. The method of claim 1, wherein the liquid binder of the bond coat slurry comprises at least one of an ethyl polysilicate binder or other silicon alkoxide binder.

3. The method of claim 2, wherein the ceramic composite slurry applied to the at least partially dried bond coat comprises the at least one of the ethyl polysilicate binder or other silicon alkoxide binder.

4. The method of claim 1, wherein the at least one of glass particles or glass-ceramic particles comprise glass-ceramic powder.

5. The method of claim 4, wherein the glass-ceramic powder comprises at least one of Ba—Ba—Si—Al—Mg—B, or Ba—Sr—Ca—Si—Al—Mg—B.

6. The method of claim 1, wherein the bond coat slurry comprises a catalyst for a sol-gel reaction of the bond coat.

7. The method of claim 1, wherein the ceramic oxide particles comprise at least one of MgO, $Al_2O_3$, or $MgAl_2O_4$ particles.

8. The method of claim 1, wherein the metal substrate comprises the metal substrate of an in-service component.

9. The method of claim 8, wherein the in-service component comprises an exhaust component of a gas turbine engine mounted to an aircraft.

10. The method of claim 9, wherein heating the dried bond coat and the ceramic composite slurry layer to form a repaired portion of the thermal barrier coating system on the metal substrate comprises heating the dried bond coat and the ceramic composite slurry layer via exhaust gas of the gas turbine engine.

11. The method of claim 1, wherein at least a portion of the ceramic oxide particles remain unreacted following the heating of the dried bond coat and the ceramic composite slurry layer.

12. The method of claim 1, wherein the metal substrate comprises a nickel superalloy, a cobalt superalloy, or a titanium alloy.

13. The method of claim 1, further comprising leaving the in-service component as part of an assembly of which the in-service component is a part throughout the method of claim 1.

* * * * *